United States Patent [19]

Bailey

[11] Patent Number: 4,786,026

[45] Date of Patent: Nov. 22, 1988

[54] REMOVABLE, COLLAPSIBLE BULKHEAD ASSEMBLY

[75] Inventor: Augustus W. Bailey, Barberton, Ohio

[73] Assignee: James W. Smith, Jr., Richfield, Ohio

[21] Appl. No.: 180,001

[22] Filed: Apr. 11, 1988

Related U.S. Application Data

[63] Continuation of Ser. No. 001,650, Jan. 8, 1987, abandoned.

[51] Int. Cl.[4] ..... E01C 19/50

[52] U.S. Cl. ..... 249/9; 249/84; 249/112; 249/131; 249/219.1; 404/48; 404/74; 404/87

[58] Field of Search ..... 249/4, 5, 8, 9, 14, 249/83–85, 112, 155, 154, 158, 161, 170, 189, 208, 210, 219.1, 130, 131; 217/57, 59, 62; 220/253, 254, 251, 259, 263, 287, 331, 336; 425/DIG. 58; 404/48, 74, 87; 264/297.9

[56] References Cited

U.S. PATENT DOCUMENTS

| | | | |
|---|---|---|---|
| 1,037,907 | 9/1912 | Heltzel | 249/5 |
| 1,124,327 | 1/1915 | Park | 249/157 |
| 1,644,584 | 10/1927 | Heltzel | 249/5 |
| 1,803,719 | 5/1931 | Miller | 249/159 |
| 2,359,214 | 9/1944 | George | 249/85 |
| 2,610,381 | 9/1952 | Rosati et al. | 249/2 |
| 2,626,444 | 1/1953 | Wolf et al. | 249/6 |
| 3,069,138 | 12/1962 | Darby | 249/205 |
| 3,823,910 | 7/1974 | Crosier | 249/14 |
| 4,266,750 | 5/1981 | Gallizia | 425/DIG. 58 |
| 4,533,111 | 8/1985 | Cousin | 249/2 |

FOREIGN PATENT DOCUMENTS

| | | | |
|---|---|---|---|
| 1126337 | 6/1958 | France | 425/DIG. 58 |
| 1406950 | 6/1965 | France | 425/DIG. 58 |

*Primary Examiner*—Jay H. Woo
*Assistant Examiner*—James C. Housel
*Attorney, Agent, or Firm*—Daniel J. Hudak Co.

[57] ABSTRACT

A collapsible concrete bulkhead is insertable into a framework. The bulkhead has a pivotable divider plate which is located juxtaposition to a bulkhead plate and moves laterally thereof to reside in an offset base portion of the framework. The bulkhead assembly forms separate concrete sections when concrete is poured into the framework and forms a gap when the bulkhead assembly is removed. Optionally, a liner can be inserted adjacent to the bulkhead assembly and the bulkhead assembly removed before full cure of the concrete so that the concrete fills the void left by the bulkhead with the liner separating the concrete sections.

10 Claims, 2 Drawing Sheets

REMOVABLE, COLLAPSIBLE BULKHEAD ASSEMBLY

CROSS-REFERENCE

This application is a continuation of application Ser. No. 001,650 fild Jan. 8, 1987 and now abandoned, for "A REMOVABLE, COLLAPSIBLE BULKHEAD ASSEMBLY."

FIELD OF THE INVENTION

The present invention relates to a bulkhead assembly and to a method of efficiently constructing adjacent concrete wall section having a gap or liner therebetween. More specifically, the present invention relates to a bulkhead assembly having a laterally, pivotable divider plate which is insertable into a concrete framework along with an option liner so that after pouring concrete into said framework, the bulkhead assembly containing the divider plate can be removed and separate concrete wall sections formed.

BACKGROUND

Heretofore, various walls such as bridge sections have been formed by piecemeal construction. That is, once a concrete section had been formed, a flexible rubber liner was placed on the end thereof, and the process repeated until an entire structure had been formed. Another method of assembly was to form alternating concrete sections, place the rubber liner on the end of each section and then form the remaining sections. Such methods were time consuming and costly.

U.S. Pat. No. 1,037,907 to Heltzel relates to a division plate which is insertable between concrete sections which form various items such as a curb.

U.S. Pat. No. 1,644,584 to Heltzel relates to a division plate having overlapping sections which are connected together through a pivot pin. The division plates contain an opening or slot which resides upon a side rail. After the concrete is poured, the division plates can be removed.

U.S. Pat. No. 2,359,214 to George relates to a core member for a mold having at least two substantially identical sections, a member hingedly connecting the sections together at one end and a spring spaced from the hinge end of the sections and normally urging said sections apart.

U.S. Pat. No. 2,610,381 to Rosati, et al, relates to a reuseable, demountable form which is used to build an overflow opening and an adjacent curb section of a road bed.

U.S. Pat. No. 2,626,444 to Wolf, et al, relates to a flexible form for integral concrete curbs and gutters.

U.S. Pat. No. 3,069,138 to Darby relates to a tied arch jacking frame for simultaneous pretensioning longitudinal and tranverse reinforcing rods used in making reinforced, prestressed concrete slabs.

U.S. Pat. No. 4,533,111 to Cousin relates to a system for constructing concrete barriers on a roadway with adequate spacing between sections of the barrier for proper drainage and expansion of the concrete where a temporary, removable core is located in the space between preparation of the concrete barriers and wherein said core contains an inner removable layer.

SUMMARY OF THE INVENTION

It is therefore an aspect of the present invention to provide a removable, collapsible bulkhead assembly for forming a gap or positioning a liner between adjacent concrete wall sections.

It is a further aspect of the present invention to provide a collapsible bulkhead assembly, as above, having a laterally movable divider plate pivotably attached to a bulkhead plate.

It is still a further aspect of the present invention to provide a collapsible bulkhead assembly, as above, wherein said bulkhead assembly can be inserted into a concrete framework along with a liner, said divider plate laterally moved into an offset of said framework, concrete poured into said framework, said bulkhead assembly collapsed and removed whereby said liner is positioned between said adjacent concrete wall sections.

It is yet a further aspect of the present invention to provide a collapsible concrete bulkhead, as above, wherein the installation of said liner is rapid, efficient, and results in a substantial cost savings over prior art methods.

These and other aspects of the present invention will become apparent from the following detailed specification.

In general, a removable, collapsible concrete bulkhead assembly comprises a bulkhead plate and a divider plate, said divider plate located juxtaposition to said bulkhead plate, said divider plate pivotably attached to said bulkhead plate and moveable in a lateral direction with respect to said bulkhead plate, said bulkhead assembly capable of being contained in a framework having a top opening, said divider plate capable of lateral movement in said framework, said bulkhead assembly removable from said top opening when said divider plate is located juxtaposition to said bulkhead plate.

DETAILED DESCRIPTION OF THE INVENTION

Figure 1:
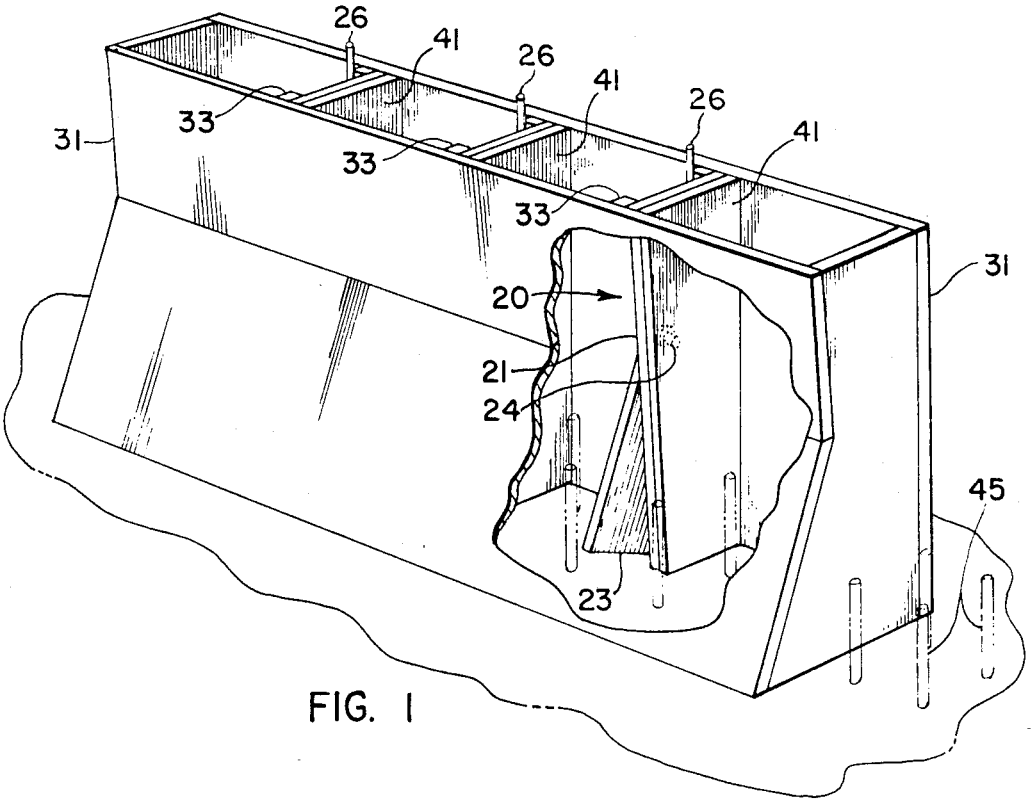
FIG. 1 is a perspective view showing the collapsible concrete bulkhead assembly of the present invention within a framework.

According to the present invention, a removable, collapsible concrete bulkhead assembly is utilized to form the end wall of at least two or more concrete wall sections and to either form a gap or to align and position a liner between the sections. The present invention is applicable to any concrete wall structure such as building walls, curbs, bridge guard rails, and the like so that a gap, expansion joint, etc., optionally containing a liner, is formed between adjacent sections. The invention will be discussed with regard to the facile preparation of a concrete bridge wall or guardrail although it is to be understood that it can be applied to numerous concrete wall structures wherever a gap or a liner therebetween is desired.

The collapsible concrete bulkhead assembly of the present invention is generally indicated by the numeral 20. The assembly can be made out of any suitable or convenient material, usually a metal such as steel although various plastics such as acrylonitrile-butadiene-styrene terpolymer (ABS), polyvinylchloride, nylon, and the like can also be utilized. The bulkhead assembly contains bulkhead plate 21. The width of the bulkhead plate is generally constant throughout its height or is smaller at its base so that the bulkhead plate can be pulled out of a framework for forming a concrete wall described hereinbelow in greater detail. Generally, the framework has a broader base portion than at the top, and hence such a flared portion forms an offset as in a building wall, a concrete bridge wall or guardrail, and the like.

At least one divider plate 23 is located juxtaposition to bulkhead plate 21 and is capable of lateral movement such that it can extend into the offset portion of the framework and be retracted, that is collapsed. The height of divided plate 23 can vary and generally is of a sufficient height so that when moved laterally, it extends into the offset portion of the framework. Any number of engagement means between the divider plate and the bulkhead plate can be utilized such as a pivot pin 24. Naturally, the height of the pivot pin is such that divider plate 23 can be pivotably moved so that it substantially fills the offset portion of the framework. The depth of the divider plate generally extends to the bottom of the bulkhead plate. The width of the divider plate can extend up to the width of the bulkhead plate. In other words, it is of equal, or less width than the bulkhead plate so that when retracted into an alignment position with the bulkhead plate, it can be readily removed through the top opening of the framework. The divider plate is generally made out of metal although, like the bulkhead plate, it can also be made out of plastic or other material. Since divider plate 23 generally resides on the bulkhead plate, it slidably engages the same.

Inasmuch as divider plate 23 generally does not extend to the top of bulkhead plate 21, an arm 26 is connected thereto. Arm 26 functions as a lever and is generally connected to the top portion of the divider plate and extends upwardly beyond the top of bulkhead plate 21 through the framework opening so that it can be grasped by a person. Arm 26 can generally be in the form of a rod or the like and can be either fixably attached as by welding or pivotally attached to the divider plate. Thus, upon downward movement of arm 26, the divider plate can be moved laterally into the offset portion of the framework. Upon an upward movement of the arm, the divider plate is laterally moved, that is collapsed into alignment with the bulkhead plate and located juxtaposition thereto so that the entire bulkhead assembly 20 can be readily removed from the framework when desired.

Considering now the application of the collapsible concrete bulkhead assembly, it will be discussed, as noted above, with regard to a concrete bridge wall rail. In order to obtain a secure engagement of the bridge wall or guardrail, rebars 45 are attached to the base of the bridge, that is the roadway, and have an end thereof extending generally vertically upward at the side or end of the roadway. Various local, state, and federal laws generally prohibit the building of bridge guardrails and the like with any degradable material such as wood between the various concrete guardrail sections. Heretofore, alternating sections would be built of a wooden framework. Upon curing or setting up of the concrete, the end portion of the wooden framework would be removed. Generally a liner, for example rubber, would then be placed against the cured concrete sections, and then the framework constructed with regard to the remaining concrete sections which were then poured and cured. In this manner, half of the various concrete guardrail sections would be constructed, the wooden end portions removed, the rubber liners placed thereon, and the remaining concrete guardrails constructed. However, such a process was and is time-consuming and costly.

According to the present invention, the entire guardrail framework is constructed and collapsible concrete bulkhead assemblies 20 placed at desired locations. If a filled gap is desired, a liner is inserted and resides against the bulkhead assembly. Concrete is then poured into the framework. If a liner is utilized, collapsible concrete bulkhead assemblies 20 are removed therefrom before full curing of the concrete.

Figure 2:
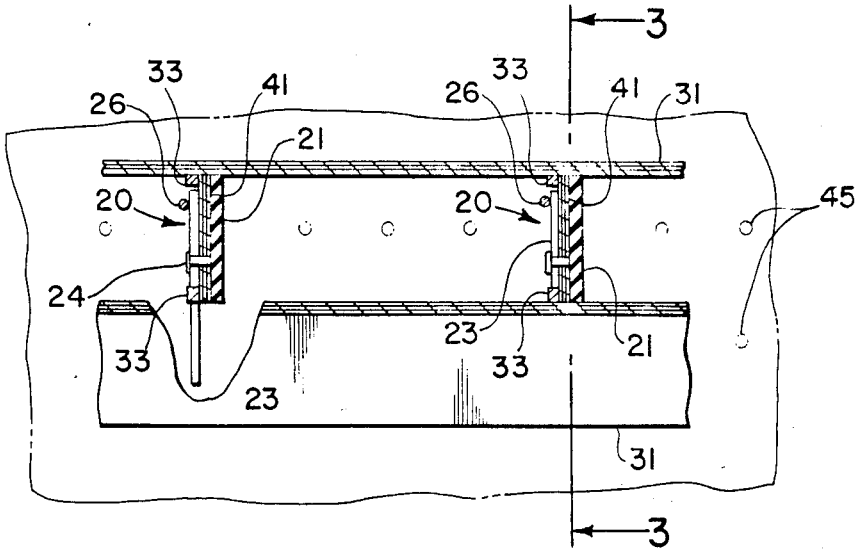
FIG. 2 is a top plan view showing the concrete bulkhead assembly and a compressible liner in place between two adjacent concrete wall sections.
Figure 3:
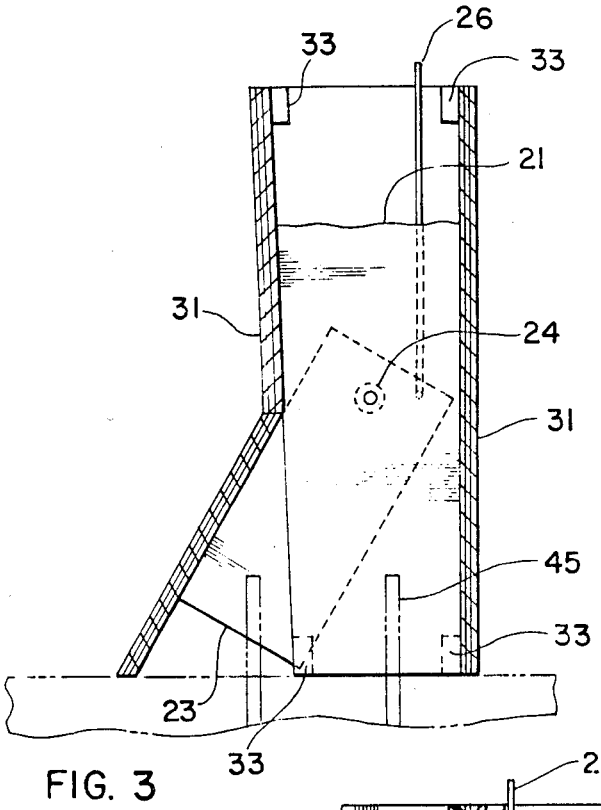
FIG. 3 is an enlarged and end elevational view of the concrete bulkhead assembly.
Figure 4:
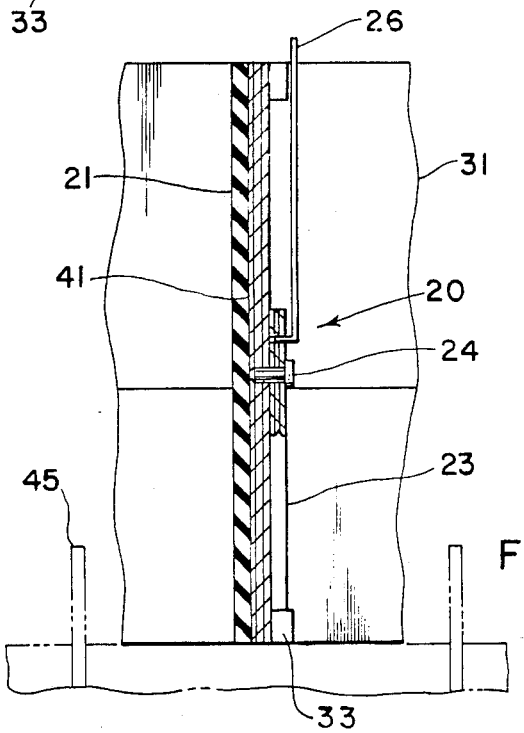
FIG. 4 is a side elevational view showing the bulkhead assembly and a compressible liner located between two concrete wall sections.

As best seen in FIGS. 1 and 2, framework 31, typically made of wood, can be built along the entire length of the bridge. The top of the framework is open so that concrete can be poured therein. At suitable distances along framework 31, gaps are desired to permit expansion or slight relative movement of the guardrail sections. At each gap location, a bulkhead assembly 20 is inserted which is generally maintained in an accurate vertical alignment through the existence of alignment blocks 33 or the like. Generally, the total or entire collapsible concrete bulkhead assembly, except for the arm or a substantial portion thereof, resides within the framework. If desired, a liner is placed against each bulkhead assembly 20. The guardrail usually has a lateral offset portion as seen in FIGS. 1 and 3 in order to provide stability. Naturally, the bulkhead assembly is inserted into the framework with divider plate 23 located in a collapsed position, that is in alignment with bulkhead plate 21. After full or total insertion of the bulkhead assembly 20 into the framework, arm 26 is moved downward thereby causing divider plate 23 to move laterally into the offset portion. Optionally, liner 41 is placed against the bulkhead assembly. The liner can be made of any suitable material which is compressible, elastic or resilient such as rubber, a flexible foam material such as polyurethane, and the like. The entire framework which resides over the vertically extending rebars at the bridge side can now be filled with concrete to a desired level along the entire length of the bridge. Naturally, the poured concrete of one section will bear against bulkhead assembly 20, and in an adjacent section either against optional compressible liner 41 or against the remaining side of the bulkhead.

When a liner is utilized, before substantial setting up or curing of the concrete, divider plate 23 is laterally swung into alignment juxtaposition to bulkhead plate 21 by upward movement of arm 26 and bulkhead assembly 20 lifted vertically upward and out of framework 31. Inasmuch as the concrete has not sufficiently set, it will flow into the small void created by removal of the bulkhead assembly and bear against liner 41. The concrete guardrail sections are then allowed to fully cure or set up. Framework 31 is then removed leaving a bridge concrete guardrail in the form of a plurality of sections with liners 41 residing between the sections. The net result is an efficient, rapid and low cost assembly of a concrete bridge wall or guardrail. The same construction method can be applied to other types of walls as noted above whenever a gap or a resilient material is desired between various concrete sections.

While in accordance with the patent statutes, a best mode and preferred embodiment have been set forth, the scope of the invention is not limited thereto, but rather by the scope of the attached claims.

What is claimed is:

1. A removable, collapsible concrete bulkhead assembly for use in a framework, comprising:

the bulkhead assembly containing a bulkhead plate and a divider plate, said divider plate located juxtaposition to said bulkhead plate, said divider plate pivotally attached to said bulkhead plate and movable in a lateral direction with respect to said bulkhead plate, a liner, said liner located in said framework and residing against said bulkhead assembly, said bulkhead assembly contained in a framework having a top opening, said divider plate capable of lateral movement in said framework, said bulkhead assembly removable from said top opening when said divider plate is located juxtaposition to said bulkhead plate.

2. A removable, collapsible concrete bulkhead assembly according to claim 1, wherein the width of said divider plate is the same or less than the width of said bulkhead plate.

3. A removable, collapsible concrete bulkhead assembly according to claim 2, wherein said framework contains an offset therein, and wherein said divider plate is laterally movable into and out of said offset.

4. A removable, collapsible concrete bulkhead assembly according to claim 3, including an arm, said arm connected to said divider plate, said arm capable of imparting lateral movement to said divider plate.

5. A removable, collapsible concrete bulkhead assembly according to claim 4, wherein said divider arm extends upwardly and out of said framework opening, and wherein said liner is a resilient material.

6. A removable, collapsible concrete bulkhead assembly according to claim 5, wherein said divider plate slidably engages said bulkhead plate.

7. A removable, collapsible concrete bulkhead assembly according to claim 6, wherein said divider plate has a lesser height than said bulkhead plate height.

8. A removable, collapsible concrete bulkhead assembly in combination with a framework, comprising:

the bulkhead assembly containing a bulkhead plate, a divider plate, and an arm connected to said divider plate, the width of said divider plate being the same or less than the width of said bulkhead plate and said divider plate being located juxtaposition to, pivotally attached to, and movable in a lateral direction with respect to said bulkhead plate;

the framework having a top opening and an offset, said bulkhead assembly located transversely in said framework, said arm extending upwardly out of said top opening and being capable of imparting to said divider plate lateral movement into and out of said offset prior to removal of said assembly from said framework, and said bulkhead assembly being removable from said top opening when said divider plate is located juxtaposition to said bulkhead plate.

9. A removable, collapsible concrete bulkhead assembly according to claim 8, wherein said divider plate slidably engages said bulkhead plate.

10. A removable, collapsible concrete bulkhead assembly according to claim 8, wherein said divider plate has a lesser height than said bulkhead plate height.

* * * * *